US005228809A

United States Patent [19]

Yoshida et al.

[11] Patent Number: 5,228,809

[45] Date of Patent: Jul. 20, 1993

[54] CONSOLIDATING AGENT INJECTING APPARATUS AND INJECTING APPARATUS FOR IMPROVING GROUND

[75] Inventors: Hiroshi Yoshida, Tokorozawa; Mitsuhiro Shibazaki, Tokyo; Hiroaki Kubo, Nakamuraminami; Shunji Jinbo, Koyama, all of Japan

[73] Assignee: Kajima Corporation, Tokyo, Japan

[21] Appl. No.: 741,227

[22] Filed: Aug. 5, 1991

Related U.S. Application Data

[63] Continuation of Ser. No. 471,618, Jan. 29, 1990, abandoned.

[30] Foreign Application Priority Data

Jan. 27, 1989 [JP] Japan ..... 1-16321
Jan. 27, 1989 [JP] Japan ..... 1-16322

[51] Int. Cl.[5] ..... E02D 7/24
[52] U.S. Cl. ..... 405/269; 405/266
[58] Field of Search ..... 405/258, 263–269; 239/416.1, 422, 424.5, 425

[56] References Cited

U.S. PATENT DOCUMENTS

| | | | |
|---|---|---|---|
| 2,126,576 | 8/1938 | Ranney | 405/268 X |
| 2,813,750 | 11/1957 | Marantz | 239/422 X |
| 3,138,330 | 6/1964 | Gilbert | 239/422 X |
| 3,528,252 | 9/1970 | Gail | 405/258 X |
| 3,848,807 | 11/1974 | Partida | 239/422 X |
| 4,601,612 | 7/1986 | Primrose | 405/269 X |
| 4,624,606 | 11/1986 | Nakanishi et al. | 405/269 |
| 4,666,346 | 5/1987 | MacLeod | 405/269 |
| 4,786,212 | 11/1988 | Bauer et al. | 405/269 |

FOREIGN PATENT DOCUMENTS

| | | | |
|---|---|---|---|
| 20802 | 2/1980 | Japan | 405/269 |
| 56-26730 | 6/1981 | Japan . | |
| 57-38728 | 8/1982 | Japan . | |
| 57-55849 | 11/1982 | Japan . | |
| 190827 | 11/1982 | Japan | 405/258 |
| 58-30444 | 6/1983 | Japan . | |
| 138113 | 7/1985 | Japan | 405/269 |
| 727742 | 4/1980 | U.S.S.R. | 405/263 |
| 953092 | 8/1982 | U.S.S.R. | 405/269 |
| 975896 | 11/1982 | U.S.S.R. | 405/269 |
| 1310478 | 5/1987 | U.S.S.R. | 405/269 |
| 7085 | of 1914 | United Kingdom | 405/269 |

*Primary Examiner*—Dennis L. Taylor
*Assistant Examiner*—John Ricci
*Attorney, Agent, or Firm*—Beveridge, DeGrandi, Weilacher & Young

[57] ABSTRACT

The present invention relates to a consolidating agent injecting apparatus having a nozzle mounted at the end of a pipe. The apparatus is inserted in a guide hole formed in the ground and the nozzle injects a high pressure jet liquid in a radial direction. The injecting direction of the nozzle is downwardly inclined from the horizontal direction within a range from 15 to 45 degrees. The present invention also relates to a ground improving injecting apparatus having first and second nozzles, mounted at the end of a pipe, for injecting a high pressure liquid and a ground improving injection liquid. The first nozzle comprises a plurality of annularly-arranged nozzles. The pipe is inserted into a hole dug in the ground and the high pressure liquid and the ground improving injection liquid are injected from the first and second nozzles. As the pipe is drawn up from under the ground, the ground is dug and grouted and the ground improving injection liquid is injected to form an underground columnar consolidation body and thereby improve the ground. The consolidating agent injecting apparatus and ground improving injection apparatus of the present invention form a consolidation body of a large section area for improvement of the ground, without transitions of the jet streams to turbulent flow.

10 Claims, 5 Drawing Sheets

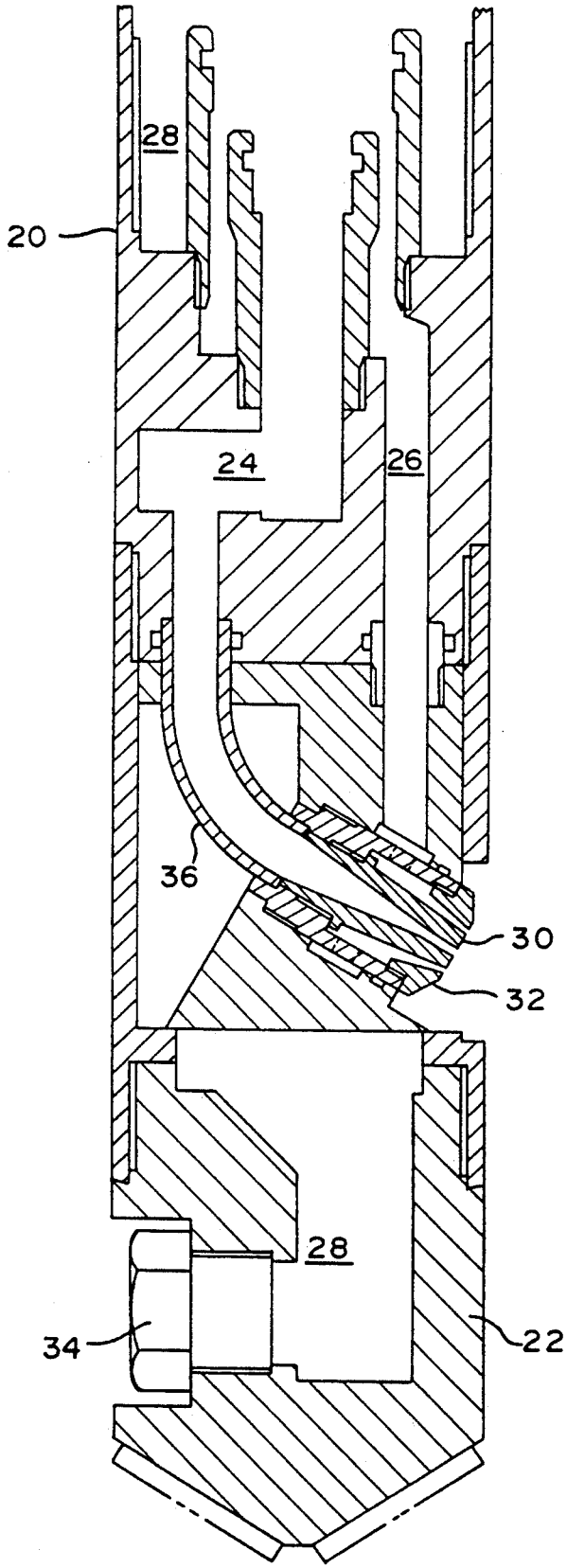
FIG. 2
FIG. 3
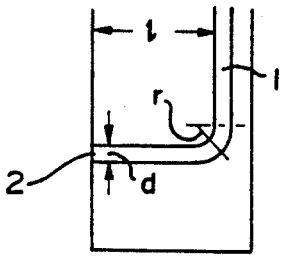
PRIOR ART

FIG. 5
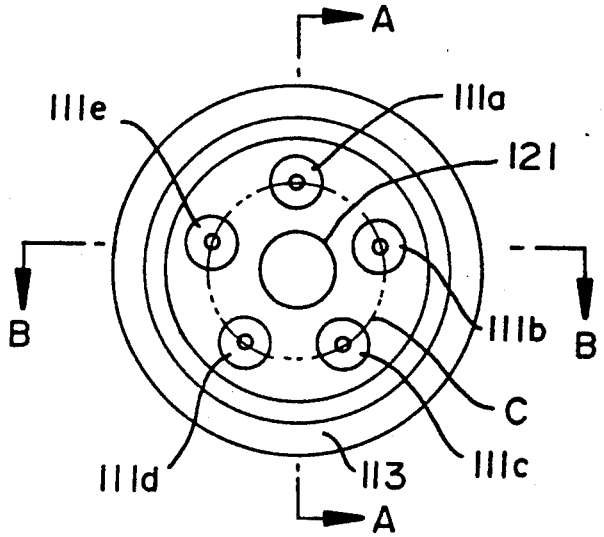
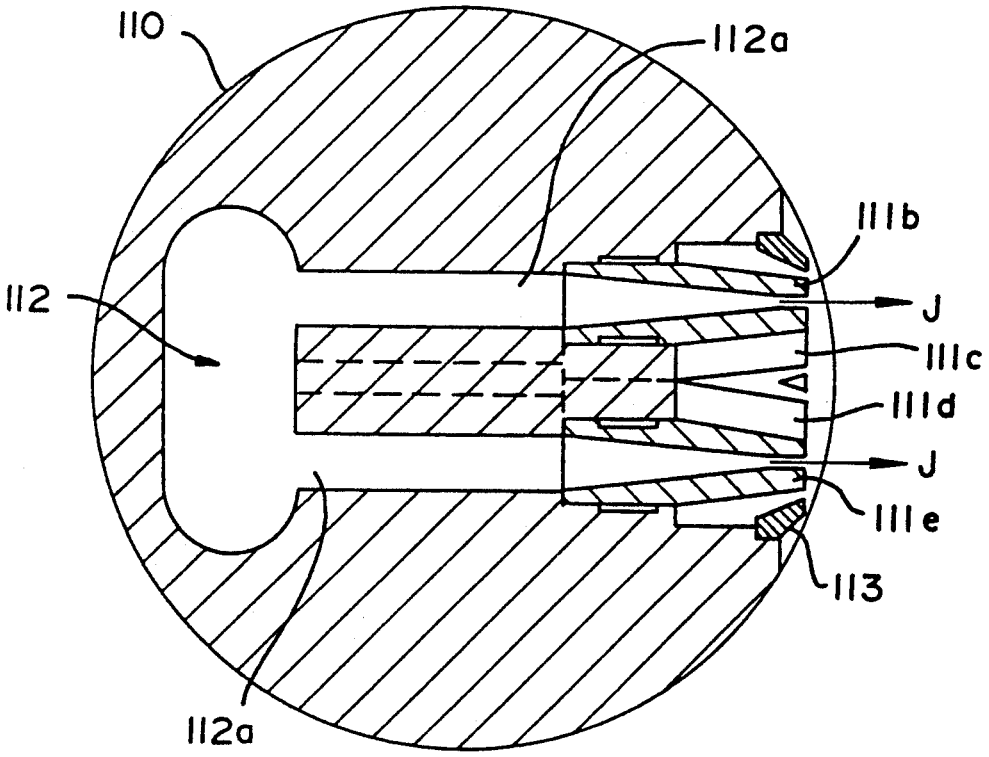
FIG. 7

CONSOLIDATING AGENT INJECTING APPARATUS AND INJECTING APPARATUS FOR IMPROVING GROUND

This is a continuation of application Ser. No. 07/471,618, filed Jan. 29, 1990, now abandoned.

FIELD OF THE INVENTION

The present invention relates to a consolidating agent injecting apparatus including a nozzle mounted at the tip of a pipe inserted in a guide hole formed in the ground. The nozzle injects a high pressure jet liquid in an outer radial direction to form an underground columnar consolidation body of a large area.

The present invention also relates to the improvement of an injecting apparatus for improving a ground area. A pipe is inserted into a hole previously formed in the ground and a high pressure liquid and a ground improving injection liquid are injected from first and second nozzles attached to the tip of the pipe. As the pipe is drawn up from the underground, the ground is dug and grouted, the ground improving injection liquid is injected, and an underground columnar consolidation body is formed to thereby improve the ground.

DESCRIPTION OF THE BACKGROUND ART

In digging and grouting the ground by using a nozzle for injecting a high pressure liquid (hereinafter, referred to as a nozzle) of a consolidating agent injecting apparatus (hereinafter, referred to as a monitor), the shape of the fluid (i.e., jet stream) existing at a position ahead of the nozzle (i.e., the shape of the jet stream injected from the nozzle) is largely influenced by conditions of flow in the pipe prior to the nozzle. Ideally, the flow in the pipe is a laminar flow. However, it is experimentally known that if the velocity of the fluid in the pipe is set to 10 m/sec or less, the influence of these flow conditions against the jet stream can be ignored.

FIG. 3 shows a conventional nozzle 2. Since nozzle 2 is formed in a position arranged in the direction of 90° from a fluid transport pipe passageway 1 (hereinafter, referred to as a pipe passageway), the flowing direction of the fluid is perpendicularly changed with a small radius r of curvature in a short distance l from the pipe passageway 1 to the nozzle 2. Thus, a turning flow occurs in the curved portion of the pipe passageway 1, the vector component in the horizontal direction decreases, and a loss of motive power occurs. In addition, a flow state of the fluid becomes turbulent at a position before the nozzle 2 and the flow passes as turbulent flow in the nozzle 2. As a result, an ideal jet stream of laminar flow cannot be obtained. Furthermore, the value of the diameter of the pipe passageway 1 is small and the flow rate is also small (e.g., 100 liters per minute) so that grouting efficiency is low.

In recent years, a demand has arisen to construct an underground columnar consolidation body of a large section area having a large diameter. However, when the diameter of the pipe passageway is increased and the flow rate is set to a large value (e.g., 300 to 400 liters/min.), the above-mentioned loss of motive power, turbulent flow, and other technical problems will occur.

As is well known, to eliminate the turning flow, assuming that the diameter of the pipe passageway is set to d, a distance of $=100$ to 150 d is needed. However, if the diameter d is set to a large value such as to eliminate the turning flow, the distance l also increases. In the monitor, the nozzles are mounted at opposite positions to counterbalance the injection reaction forces thereof and the outer diameter of the monitor is generally relatively small (e.g., generally 10 cm). Therefore, if the length of the rectilinear portion of the nozzle is set to be long so as not to cause any turning flow even in the case of a large flow rate, the rectilinear portion cannot be enclosed in the monitor.

On the other hand, the above-mentioned ground improving injecting apparatus is attached to the tip of the pipe. In the case of forming a cylindrical ground improving portion, the pipe is drawn up while being rotated. In the case of forming a vertical flat plate shaped ground improving portion, the pipe is drawn up without rotation thereof. In these manners, the ground improving injecting apparatus is used. However, there are problems similar to those in the foregoing consolidating agent injecting apparatus.

That is, as shown in FIG. 8, the ground improving injecting apparatus ordinarily has one nozzle for injecting the high pressure liquid. In order to reduce the outer diameter of an injecting apparatus 101, a pipe passageway 103 extending to a nozzle 102 is perpendicularly bent in the inlet portion of the nozzle 102. As a result, the jet fluid becomes a turbulent flowing state in a rectilinear portion 104 and directly passes through the nozzle 102 while remaining in the turbulent flowing state. Furthermore, a jet stream J does not achieve a theoretical flow and the grouting capability is low. Thus, in the conventional ground improving injecting apparatus, in order to improve the grouting capability, the injecting pressure and/or flow rate are controlled so as to increase within a fine range, and/or the grouting time is prolonged.

In order to reduce the turbulence of the jet stream J, it is necessary to produce laminar flow so as not to cause any turbulent flow in the rectilinear portion 104. Referring to FIG. 9, such a requirement depends on the pipe diameter d, the length l of the rectilinear portion 104, and the flow rate in the portion 104. As is well known, in order to completely produce laminar flow, the optimum value of l/d should be set to $100\sim150$.

On the other hand, a limitation exists in the case of the pipe diameter of double pipes (or triple pipes where three kinds of liquids, i.e., a high pressure liquid, a low pressure liquid, and a ground improving injection liquid, are injected) arranged in the pipe passageway. These pipes transport both the high pressure liquid and the ground improving liquid in the ground improving injecting apparatus. Therefore, in order to realize the optimum value to l/d, the pipe diameter d in the rectilinear portion 104 should be minimized as possible. The desirable upper limit value of the flow velocity for realizing the laminar flow is set to 10 m/sec; however, a flow velocity higher than 10 m/sec is not preferable. That is, since the pipe diameter d is small and there is also a limitation of the flow velocity, the flow rate inevitably decreases. However, as the flow rate decreases, the flying distance of the jet stream J will be relatively short. Thus, grouting capability will deteriorate.

To form an underground columnar consolidation body of a large section area having a large diameter, a large grouting capability is necessary. According to studies by the inventors of the present invention, grouting capability is largely influenced by a discharge amount of the jet stream J rather than a discharge pressure thereof, and flow rate of 300 liters per minute or more is preferable.

In the conventional consolidating agent injecting apparatus and ground improving injecting apparatus, to prevent the jet stream from reaching a turbulent flow state, predetermined limits for the diameter and/or length of the rectilinear portion of the nozzle are necessary. However, as discussed above, various problems arise due to such limitation.

Conventional techniques have been proposed in U.S. Pat. No. 4,084,648, entitled "PROCESS FOR THE HIGH-PRESSURE GROUTING WITHIN THE EARTH AND APPARATUS ADAPTED FOR CARRYING OUT SAME", and U.S. Pat. No. 4,047,580 entitled "HIGH-VELOCITY JET DIGGING METHOD".

SUMMARY OF THE INVENTION

The present invention provides a consolidating agent injecting apparatus which can form an underground columnar consolidation body of a large diameter by a jet stream having an ideal laminar flow.

The present invention also provides a ground improving injecting apparatus in which a discharge amount of a high pressure liquid is increased without the jet stream reaching a turbulent flowing state, thereby obtaining an underground columnar consolidation body of a large section area having a large diameter.

According to the present invention, there is provided a consolidating agent injecting apparatus having a nozzle mounted at the tip of a pipe which in turn is inserted into a guide hole dug in the ground. The nozzle injects a high pressure jet liquid in an outer radial direction. The injecting direction of the nozzle for injecting the high pressure jet liquid is inclined downwardly from the horizontal direction in a range from 15° to 45°.

Also, according to the present invention, there is provided a ground improving injecting apparatus, in which a pipe is inserted into a hole previously formed in the ground. A high pressure liquid and a ground improving injecting liquid are injected from first and second nozzles mounted at the tip of the pipe. The first nozzle comprises a plurality of nozzles which are arranged annularly. As the pipe is drawn up from under the ground, the ground is dug and grouted, the ground improving injection liquid is injected, and an underground columnar consolidation body is formed. Thereby, the ground area is improved.

Preferably, a total discharge amount of the first nozzle is set to about 300 liters per minute or more. Further, in order to increase a flying distance, it is desirable to form an annular air jet stream around the outer periphery of the first nozzle which comprises a plurality of annularly-arranged nozzles. In addition, it is also preferable to arrange a second nozzle at a center of a virtual annulus, on which the nozzles (the first nozzle) are annularly arranged, in order to improve the mixing and stirring efficiencies of the ground improving injection liquid and the grouted sediments.

In the consolidating agent injecting apparatus of the present invention, since the nozzle is directed downwardly from the horizontal direction, the radius of curvature of the pipe passageway can be enlarged and the distance of the rectilinear portion can be relatively long. Also, the dynamic pressure loss is reduced, the occurrence of turbulent flow in the fluid in the pipe passageway can be prevented as much as possible, and the jet stream can become an ideal laminar flow.

When a downward angle of inclination (i.e., inclination angle from the horizontal direction) of the nozzle is set to 15° or less, an effect for producing a laminar flow will be inferior. On the other hand, when the angle is set to 45° or more, the grouting distance in the horizontal direction will be too short to be practical. Thus, for example, 30° is preferable in consideration of both conditions of the effect for producing laminar flow and the grouting distance. Therefore, the pipe passageway diameter is set to be larger than that in the conventional apparatus and an underground columnar consolidation body of a large section area having a large diameter can be constructed by the fluid, the flow rate of which is three to four times as large as the conventional one.

Also, in the ground improving injecting apparatus of the present invention, a plurality of nozzles, being arranged annularly, perform the grouting operation in a manner similar to the case using a large nozzle having a large diameter. The large diameter of the large nozzle is equal to the diameter of the virtual annulus on which the nozzles (the first nozzle) are arranged. The virtual annulus connects the positions at which each of the nozzles (the first nozzle) digs and grouts by means of mutual operation of the jet stream from each nozzle (each of the first nozzle). This operation is based on a principle similar to the so-called "group piling effect" which is, such that, a plurality of piles, being annularly-buried, mutually operate and provide an operation similar to that obtained by a pile having a cross section corresponding to the virtual annulus on which the plurality of piles are buried. A discharge amount of one nozzle is reduced to, for instance, about 50% of that of the nozzle in the conventional ground improving injecting apparatus. The diameter of the nozzle can be decreased due to this reduced amount. Thus, the jet stream becomes similar becomes similar to ideal flow, and even if the flow rate is small, the flying distance is increased.

With respect to the first nozzle (i.e., the plurality of nozzles), the grouting capability and the grouting speed are improved versus the case of injecting from a single nozzle. Further, the second nozzle provided at the center of the first nozzle improves the missing and stirring performances of the ground improving injection liquid and the grouted sediments. Also, since the jet stream can be set to an ideal laminar flowing state, the various inconveniences caused due to the limitations of the diameter and length of the rectilinear portion of the nozzle are entirely eliminated and an underground columnar consolidation body of a large section area having a large diameter can be obtained.

BRIEF DESCRIPTION OF THE DRAWINGS

FIG. 2 is a vertical sectional view showing details of the consolidating agent injecting apparatus shown in FIG. 1;

FIG. 3 is a side cross sectional view showing a main portion of a conventional consolidating agent injecting apparatus;

FIG. 5 is a front view showing a main portion of a ground improving injecting apparatus according to the present invention;

FIGS. 6 and 7 are cross sectional views taken along the lines A—A and B—B in FIG. 5;

DETAILED DESCRIPTION OF THE PREFERRED EMBODIMENT

Figure 1:
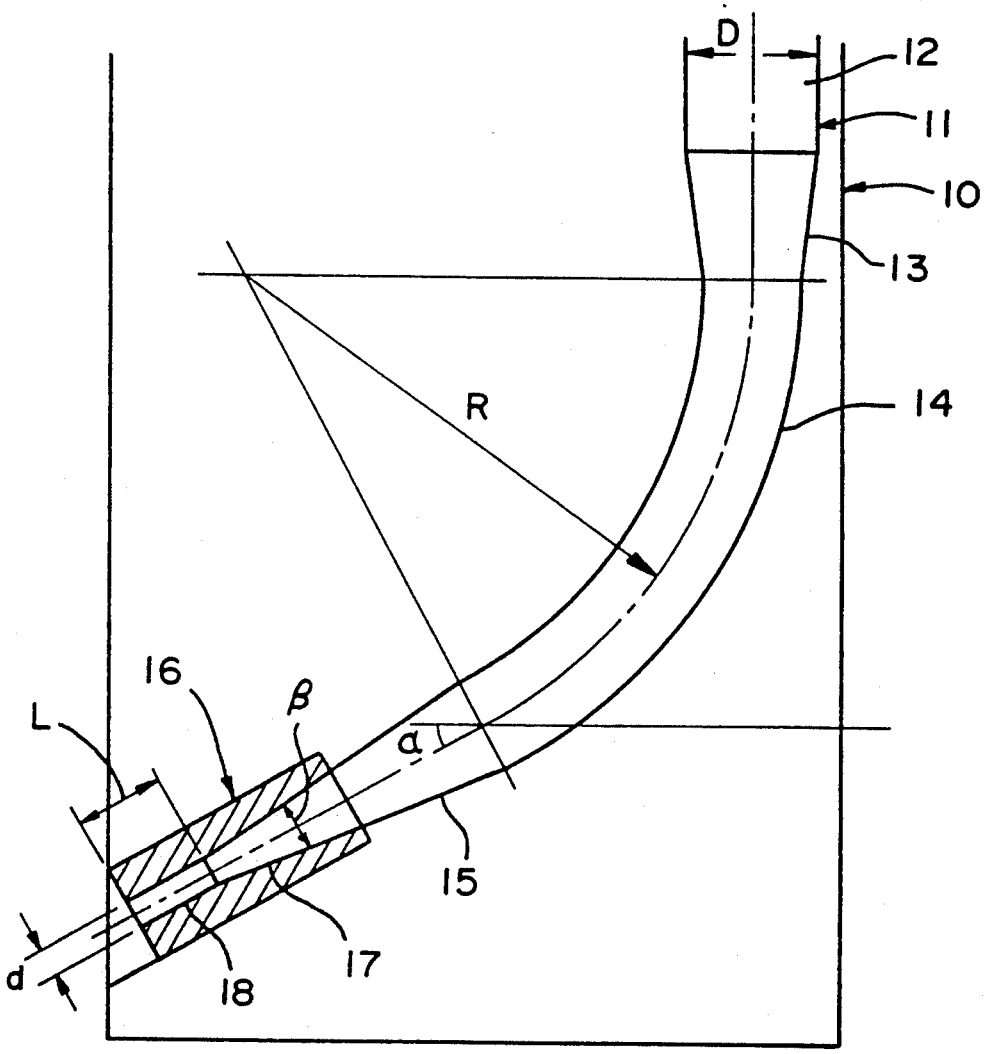
FIG. 1 is a side cross-sectional view showing the principle of a main portion of a consolidating agent injecting apparatus according to the present invention.

FIG. 1 is a diagram explaining the principle of an embodiment of the consolidating agent injecting apparatus of the present invention. A pipe passageway 11 of a monitor 10 comprises: a vertical portion 12 having a pipe diameter D; a first contracted portion 13 communicating with the vertical portion 12; a curved portion 14 having a diameter the same as that of an outlet portion of the contracted portion 13, being curved at a radius R of curvature, and having an outlet portion with an axial line direction which is downwardly inclined from the horizontal direction at an angle $\alpha$ of inclination; and a second contracted portion 15 extending in the same direction as the axial line direction of the outlet portion of the curved portion 14. The inclination angle $\alpha$ lies within a range from 15° to 45°, and in the example shown in the diagram, the angle $\alpha$ is set at 30°.

A continuous nozzle 16 is provided in the second contracted portion 15. The nozzle 16 comprises: a contracted portion 17 extending in the same direction as the axial line direction of the outlet portion of the second contracted portion 15; and a rectilinear portion 18 communicating with the contracted portion 17.

In the conventional consolidating agent injecting apparatus, since the angle $\alpha$ is set to 0°, when the pipe diameter D is set to 25 mm, the radius R or curvature is generally set to 32 mm. On the other hand, in the consolidating agent injecting apparatus of the present invention, since the angle $\alpha$ is set to 30°, the radius R of curvature is set to 71 mm. This value is about 2.2 times as long as that in the conventional apparatus. Since an angle $\beta$ of contraction of the contracted portion 17 of the nozzle 16 is set to 13°, a length L of the rectilinear portion is about three times as large as the pipe diameter d. Also, since the radius R of curvature is 2.2 times larger than that in the conventional apparatus and the degree of curve in the curved portion 14 is sufficiently gentle, the loss of dynamic pressure is small and a jet stream having a large flow rate and an ideal laminar flow is achieved.

A monitor 20 is illustrated in detail in FIG. 2. The monitor 20, having a non-core bit 22 attached at a tip thereof, includes a first pipe 24 for injecting a high pressure liquid; a second pipe 26 for blowing out a gas (for instance, compressed air); and a third pipe 28 for injecting a consolidating agent. The first pipe 24 is communicated with a first nozzle 30. The second pipe 26 is communicated with a second nozzle 32 arranged so as to surround the first nozzle 30. As shown in FIG. 2, although an edge portion of the third pipe 28 is closed by a plug (or nut) 34, when the consolidating agent is injected, another nozzle (not shown) can be attached in place of the plug 34. A curved portion 36 of the first pipe 24 corresponds to the curved portion 14 shown in FIG. 1. Also, the first nozzle 30 corresponds to the contracted portion 15, nozzle 16, contracted portion 17, and rectilinear portion 18 shown in FIG. 1.

When using the monitor 20 shown in FIG. 2, a connecting pipe (not shown) is connected to the monitor 20. A high pressure jet liquid is injected from the first nozzle 30. However, since the high pressure jet liquid is surrounded by the compressed air discharged from the second nozzle 32, the arrival distance of the high pressure jet liquid becomes long.

Figure 4:
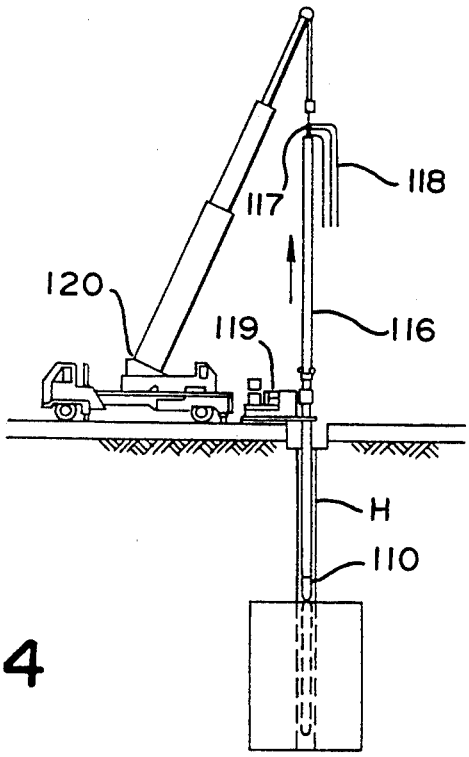
FIG. 4 is a side elevational view showing a ground improving injecting apparatus hung from a crane.
Figure 8:
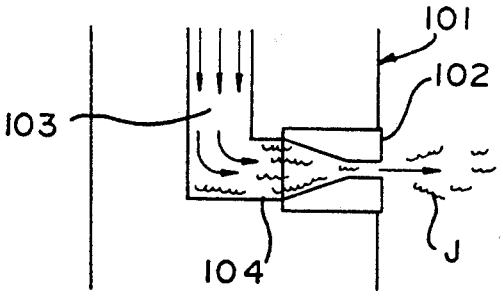
FIGS. 8 is a vertical sectional view showing a main portion of a conventional ground improving injecting apparatus.
Figure 9:
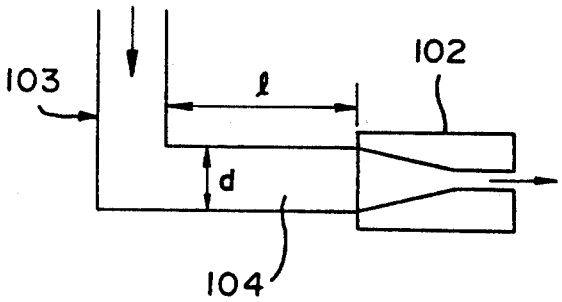
FIG. 9 is a diagram explaining a pipe passageway and a nozzle.

A ground improving injecting apparatus of the present invention will now be described with reference to FIGS. 4 to 7. FIG. 4 shows a ground improving injecting apparatus 110 hung down into a guide hole H by a crane 120. A triple pipe 116 and a triple swivel 117 are sequentially coupled to the upper portion of the ground improving injecting apparatus 110. A pipe 118 for injecting high pressure water, compressed air, and cement milk is coupled with the triple swivel 117. The high pressure water, compressed air, and cement milk flow individually in the triple pipe 116 and are led to the injecting apparatus 110, respectively. The triple pipe 116 is rotatably supported by a supporting apparatus 119 and is vertically movable by the crane 120.

Figure 6:
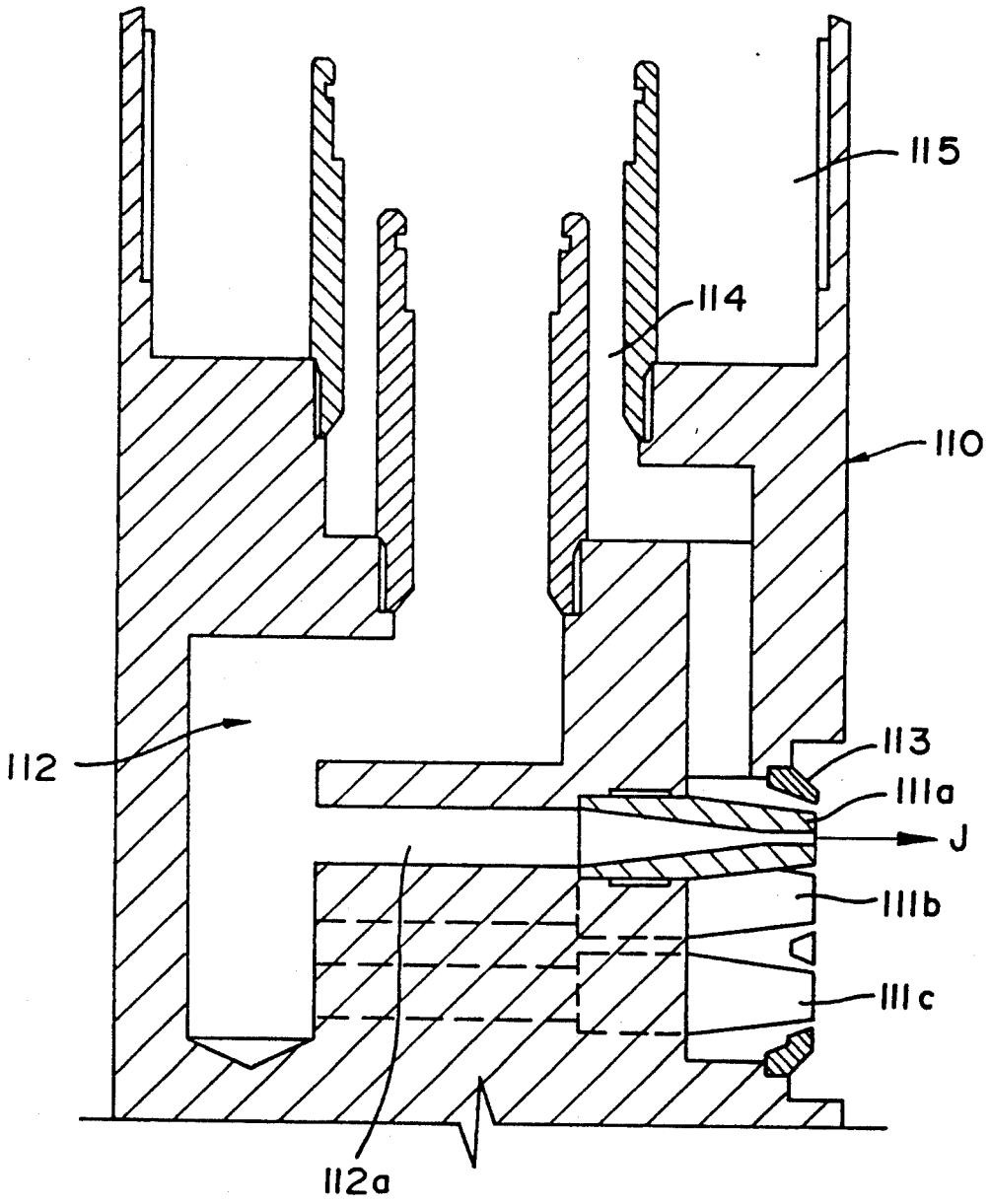

In FIGS. 5 to 7, high pressure water nozzles 111*a* to 111*e*, formed as a plurality of first nozzles (five in the example shown), are annularly arranged in a side portion of the ground improving injecting apparatus 110. In other words, the nozzles 111 are located at the respective vertex portions of a regular pentagon, respectively. A perpendicularly bent rectilinear portion 112*a* of a high pressure water pipe passageway 112 is connected to the inlet portions of the first nozzles 111, as shown in FIG. 6. A total discharge amount of the fluid discharged from the high pressure water nozzles 111 is set to about 300 liters per minute, so that the discharge amount of one nozzle is set to about 50% of that of the conventional nozzle.

A second nozzle, air nozzle 113 is provided concentrically with a virtual annulus C connecting the injection ports of the high pressure water nozzles 111, so that the nozzles 111 are surrounded by the nozzle 113. The air nozzle 113 is connected to air pipe 114. An injection liquid nozzle 121 is connected as a third nozzle to an injecting pipe passageway 115. Such an injecting liquid nozzle can be formed at the center of the virtual annulus C as shown in FIG. 5. Therefore, when high pressure water is injected from the high pressure water nozzles through the high pressure water pipe passageway 112, injection jet streams J nearly reach that of theoretical flows because the discharge amount (i.e., flow velocity) is about 50% of that in the conventional apparatus.

The five jet streams J from the high pressure water nozzles 111, annularly arranged on the virtual annulus C, execute the grouting operations as a jet stream from a single nozzle having a diameter corresponding to the diameter of the virtual ring C. Because the grouting of each jet stream can be carried out, the mutual actions of the jet streams and the effect similar to the "group piling effect" are effected. By using a large amount of high pressure water having a flow rate of 300 liters per minute, a remarkably larger grouting performance than that of the conventional apparatus is effected, so that an underground columnar consolidation body of a large section area having a large diameter is formed.

The annular air jet stream discharged from the air nozzle 113 surrounds the jet streams J of the high pressure water and functions to extend the flying distance of the high pressure water jet streams, thereby improving grouting performance.

With the consolidation agent injecting apparatus of the present invention as compared with the conventional apparatus, jet streams having ideal laminar flows (of large flow rate) are obtained, grouting distance is extended, and an underground columnar consolidation body of a large section area having a large diameter can be constructed. Furthermore, the drawback of air remaining in the grouted portion, which occurs when using a nozzle directed in a horizontal or upward direction, is eliminated, thereby improving the quality of the columnar consolidation body.

Since the jet streams from the high pressure water nozzles, annularly arranged on the virtual annulus, do not reach a turbulent flowing state, the high pressure water jet streams are similar to theoretical flows and mutually act. The grouting capability and grouting speed are improved due to the effect similar to the so-called "group piling effect". Also, since a large amount of high pressure water, set to 300 liters per minute, can be discharged, the grouting capability is remarkably improved. Therefore, an underground columnar consolidation body of a large section area having a large diameter is formed and the ground of a large section area can be improved. In addition, the mixing and stirring efficiencies of the sediments and the ground improving injection liquid are improved and the quality of the consolidation body can be improved.

In other words, according to the consolidating agent injection apparatus and a ground improving injecting apparatus of the present invention, a columnar consolidation body of a large section area having a large diameter for improvement of the ground can be easily obtained without transitions of the jet streams to turbulent flows.

What is claimed is:

1. An apparatus for injecting a consolidating agent, comprising:

a first nozzle means mounted at a tip of a pipe to be inserted into the ground, said first nozzle means being adapted to inject a liquid in an outer radial direction inclined at an angle of inclination from a horizontal direction, means for injecting a liquid through said pipe to be inserted into the ground, and means for drawings said pipe to be inserted into the ground out of the ground, said first nozzle means being connected to a substantially vertical portion of said pipe by a curved portion of said pipe which has a radius of curvature substantially larger than a diameter of said curved portion of pipe, so as to produce a jet stream discharging a relatively large amount of liquid while preventing an occurrence of turbulent flow.

2. An apparatus for injecting a consolidating agent in accordance with claim 1, wherein said radius of curvature is approximately three times the diameter of said curved portion of pipe.

3. An apparatus for injecting a consolidating agent in accordance with claim 1, wherein said angle of inclination is within a range from 15° to 45°.

4. An apparatus for injecting a consolidating agent in accordance with claim 3, wherein said angle of inclination is 30°.

5. An apparatus for injecting a consolidating agent in accordance with claim 1, wherein said first nozzle means are surrounded by a second nozzle means adapted for injecting a gas.

6. An apparatus for injecting a consolidating agent, comprising:

a first passage communicating at a first end with a tip of a pipe to be inserted in the ground, a second passage communicating with said first passage at a second end diametrically opposed to said first end, said second passage being underneath and substantially parallel to said first passage, and a first nozzle means, being adapted to inject a liquid, communicating with said second passage at a third end diametrically opposed to said second end.

7. An apparatus for injecting a consolidating agent in accordance with claim 6, wherein said first nozzle means is formed by a plurality of nozzles which are arranged annularly.

8. An apparatus for injecting a consolidating agent in accordance with claim 7, wherein said plurality of nozzles surround a third nozzle means adapted for injecting a liquid.

9. An apparatus for injecting a consolidating agent in accordance with claim 6, wherein said first nozzle means are surrounded by a second nozzle means adapted for injecting a gas.

10. A method of injecting a consolidating agent comprising the steps of:

injecting a high pressure liquid from a first nozzle means formed of a plurality of nozzles arranged annularly, injecting a high pressure gas from a second nozzle means surrounding said first nozzle means, and injecting a consolidating agent from a third nozzle means, wherein said high pressure liquid is injected from first nozzle means surrounding said third nozzle means.

* * * * *